US006036523A

United States Patent [19]

Sukegawa

[11] Patent Number: 6,036,523

[45] Date of Patent: Mar. 14, 2000

[54] CONNECTOR SOCKET

[75] Inventor: Akihito Sukegawa, Hitachinaka, Japan

[73] Assignee: Mitsumi Electric Co., Ltd., Japan

[21] Appl. No.: 09/032,610

[22] Filed: Feb. 27, 1998

[30] Foreign Application Priority Data

Feb. 28, 1997 [JP] Japan ..... 9-061853

[51] Int. Cl.[7] ..... H01R 13/627

[52] U.S. Cl. ..... 439/350; 439/345

[58] Field of Search ..... 439/345, 347, 439/350, 351, 352, 353, 354, 355, 357

[56] References Cited

U.S. PATENT DOCUMENTS

| | | | |
|---|---|---|---|
| 5,013,262 | 5/1991 | Shibano | 439/610 |
| 5,330,369 | 7/1994 | Nozaki et al. | 439/489 |
| 5,599,207 | 2/1997 | Lai | 439/567 |
| 5,605,472 | 2/1997 | Sakai et al. | 439/489 |

*Primary Examiner*—Lincoln Donovan
*Attorney, Agent, or Firm*—Morrison Law Firm

[57] ABSTRACT

A connector socket has a metallic latch member that is inserted from the rear through a latch attachment opening to position an engagement section in a plug insertion opening where it can be engaged by a lock claw of a plug inserted into a plug insertion opening in the front surface of the connector socket. The metallic engagement section resists wear from repeated plugging and unplugging of a connector plug in the connector plug opening. The latch member has transversely extending fixed support pieces integrally formed with the engagement section, which fit through guide grooves in the latch attachment opening. Reverse engagement claws extending laterally from the outer ends of the fixed support pieces dig into, and permanently retain the latch member in place. The ability to easily insert the latch member through the rear surface of the connector socket reduces assembly cost, and permits a connector socket to have any desired number of plug insertion openings in its face.

3 Claims, 4 Drawing Sheets

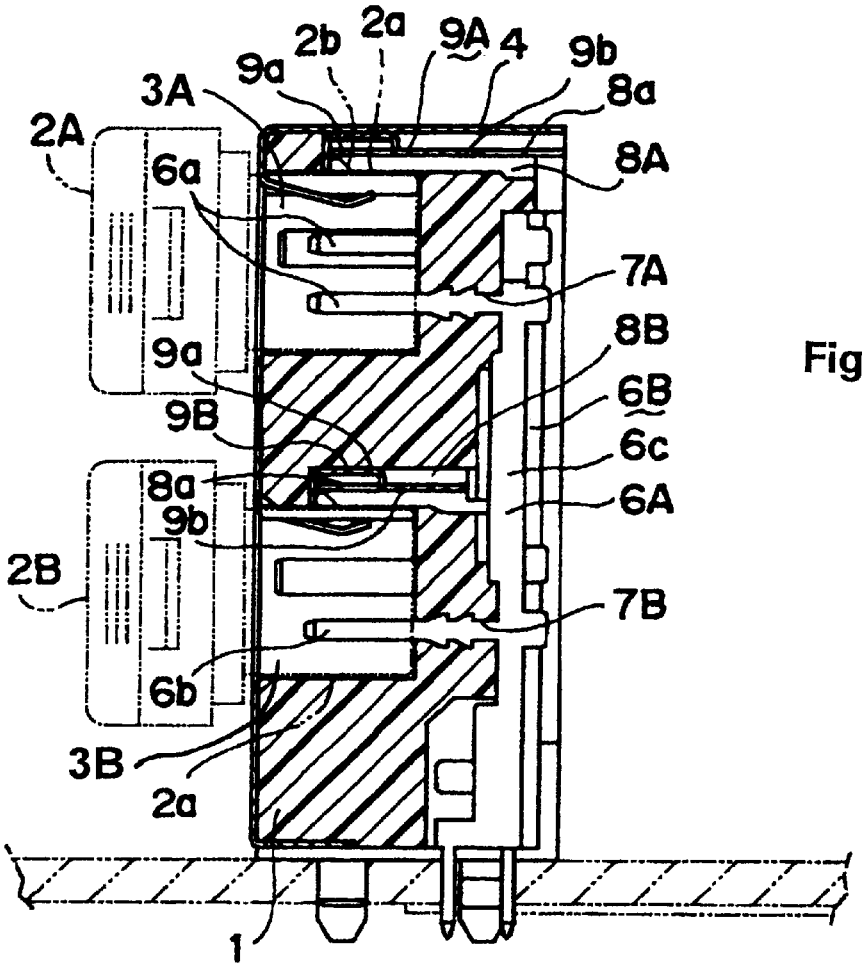
Fig. 3
Fig. 4
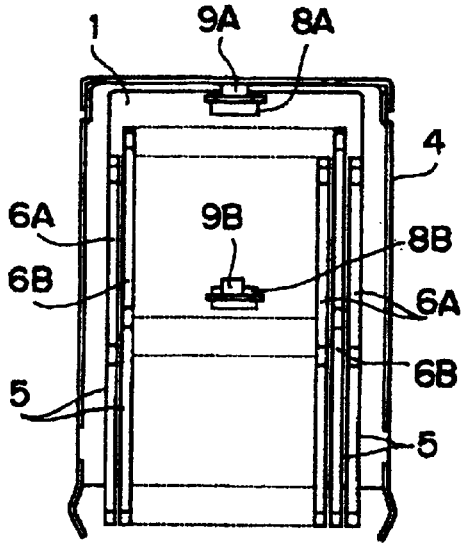

CONNECTOR SOCKET

BACKGROUND OF THE INVENTION

The present invention relates to a connector socket for connecting electronic components. In particular, the present invention relates to a connector socket in which a plurality of plug insertion openings are arranged together.

Referring to FIG. 5 and FIG. 6, connector sockets for audio-visual equipment can be formed with a plurality of plug insertion openings so that a plurality of media devices, e.g., a plurality of VCRs, can be connected in parallel.

Referring to FIG. 5 and FIG. 6, a connector socket comprises a molded block A formed by injection molding an insulating resin. Two plug insertion openings C1, C2 are formed on the surface of molded block A to allow insertion of plugs b1 of connector plugs B1, B2. A shield case D, formed by bending a thin metal plate into a box shape, covers the front surface, the side surfaces, and the upper surface of molded block A in order to shield the inside of the connector socket from external magnetic fields and electric fields. A plurality of pin slots E are formed on the back of molded block A. A fitting device (not shown) is used to insert a plurality of connector pins F1, F2, F3, F4, stamped from a thin metal plate, into pin slots E.

Connector pins F1, F2, F3, F4 are formed roughly in the shape of an inverted "L". A connection end f1 projects inside the corresponding plug insertion opening C1, C2. An external connection end f2, extending perpendicular from connection end f1, passes through corresponding pin slot E and extends past the bottom surface of molded block A to be soldered onto a conductive body g1 of a printed circuit substrate G.

With the conventional connector socket structure as described above, lock claws b2 disposed on plugs b1 of connector plugs B1, B2 are locked into plug insertion openings C1, C2. Referring to FIG. 6, latch openings H1, H2 connected to plug insertion openings C1, C2 are formed in molded block A. Lock claws b2 engage inside latch openings H1, H2. However, since molded block A itself has limited wear resistance, lengthening the lifespan requires disposing wear-resistant metallic latch members I1, I2 at the portions of latch openings H1, H2 that come into contact with lock claws b2.

Thus, with the conventional structure, metallic latch member I1 is insert molded into latch opening H1. Alternatively, a portion of shield case D facing latch opening H2 is folded into latch opening H2 to serve as latch member I2.

With the former method, where latch member I1 is insert molded, connector sockets having a plurality of plug insertion openings C1, C2 as shown in the drawing is possible. However the need to perform insert molding of latch member I1 increases production costs significantly.

Production costs are lowered with the latter method, where a portion of shield case D is used for latch member I2. However, it is not possible to use this method for connector sockets having a plurality of plug insertion openings C1, C2. Only plug insertion opening C1 can take advantage of this method, leaving plug insertion opening C2 without enhanced wear resistance.

OBJECTS AND SUMMARY OF THE INVENTION

It is an object of the present invention to provide a connector socket which overcomes the drawbacks of the conventional connector socket described above and to provide a connector socket that has low production costs, that can hold a plurality of plug insertion openings, and that has a metallic latch member that can reliably engage the lock claw of a connector plug.

In order to achieve this object, the present invention proposes a connector socket wherein at least one plug insertion opening is formed on a surface of a molded block comprising an insulating resin. A lock claw is disposed on a plug of a connector plug to be inserted in the plug insertion opening. The lock claw engages with a metallic latch member positioned inside the plug insertion opening. A latch attachment opening is formed on the molded block to allow the plug insertion opening to be reached from the back surface of the molded block. The latch member is inserted and fixed from the back side of the latch attachment opening.

Briefly stated, the present invention provides a connector socket that has a metallic latch member that is inserted from the rear through a latch attachment opening to position an engagement section in a plug insertion opening where it can be engaged by a lock claw of a plug inserted into a plug insertion opening in the front surface of the connector socket. The metallic engagement section resists wear from repeated plugging and unplugging of a connector plug in the connector plug opening. The latch member has transversely extending fixed support pieces integrally formed with the engagement section, which fit through guide grooves in the latch attachment opening. Reverse engagement claws extending laterally from the outer ends of the fixed support pieces dig into, and permanently retain the latch member in place. The ability to easily insert the latch member through the rear surface of the connector socket reduces assembly cost, and permits a connector socket to have any desired number of plug insertion openings in its face.

According to an embodiment of the invention, there is provided a connector socket for connection to a connector plug of a type having a lock claw which enters the connector socket during mating, comprising: at least one plug insertion opening in a first surface of a molded block, a latch attachment opening in the molded block, the latch attachment opening extending from the plug insertion opening to a second surface of the molded block, the second surface being opposed to the first surface, a metallic latch member, the metallic latch member including an engagement section and a fixed support piece contiguous with the engagement section, the metallic latch member being positionable through the second surface into the latch attachment opening, the engagement section being positioned inside the plug insertion opening, the latch attachment opening including at least one laterally extending guide groove, the fixed support piece including at least one reverse engagement claw dimensioned and positioned to engage a surface of the guide groove, and thereby to retain the latch member in position substantially permanently, and the engagement section being disposed in a position in the plug insertion opening providing engagement with the lock claw, when the connector plug is inserted in the plug insertion opening.

According to a feature of the invention, there is provided a connector socket comprising: a molded block, a connector insertion plug opening for a connector plug in a first surface of the molded block, a latch attachment opening in the molded block, the latch attachment opening extending from the connector insertion plug opening through a second opposed surface of the molded block, the latch attachment opening including first and second laterally extending guide grooves opening to the second surface, a metallic latch member, the metallic latch member including an engagement section and first and second laterally extending fixed support pieces, the fixed support pieces including least one reverse engagement claw extending outward therefrom, and the first and second laterally extending fixed support pieces including lateral edges fitting tightly against outer surfaces of the guide grooves, whereby the at least one reverse engagement claw dig into the molded block and retains the metallic latch member in place.

The following preferred embodiment is presented in the description below:

1) The latch member comprises a "C"-shaped engagement section and a fixed support piece formed continuously with one end of the engagement section. Reverse engagement claws are formed on either side of the fixed support piece.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 3 is a cross-section drawing of the connector socket.

FIG. 4 is a back-side view of the connector socket.

DETAILED DESCRIPTION OF THE PREFERRED EMBODIMENTS

Referring to FIGS. 1–4, there is shown a molded block 1 formed by injection molding an insulating resin. Molded block 1 is similar to the conventional structure in that two plug insertion openings 3A, 3B, into which plugs 2*a* of connector plugs 2A, 2B are inserted, are formed on a surface of molded block 1.

In order to shield the inside of connector socket A from external magnetic and electric fields, a shield case 4 formed by bending a thin metal plate into a box shape covers the front surface, the side surfaces, and the upper surface of molded block 1.

A plurality of pin slots 5 are formed at the back of molded block 1 so that they are adjacent to each other along the width of molded block 1. A plurality of shared connector pins 6A, 6B are fitted into pin slots 5 using a fitting device (not shown). Shared connector pins 6A, 6B are preferably stamped from a thin metal plate.

The corresponding connection ends in plug insertion openings 3A, 3B perform common functions. Thus shared connector pins 6A, 6B comprise pairs of connection ends 6*a*, 6*b*, which are arranged adjacent to each other in the same manner as the arrangement of plug insertion openings 3A, 3B. Shared connector pins 6A, 6B each comprises a shared section 6*c* extending vertically along corresponding pin slots 5. The base portions of connection ends 6*a*, 6*b* are supported by shared sections 6*c* in a cantilevered manner at roughly a right angle.

Connection ends 6*a*, 6*b* are inserted through openings 7A, 7B, which are formed between plug insertion openings 3A, 3B and pin slots 5. A fitting device is used so that the ends of connection ends 6*a*, 6*b* project into corresponding plug insertion openings 3A, 3B.

Figure 1:
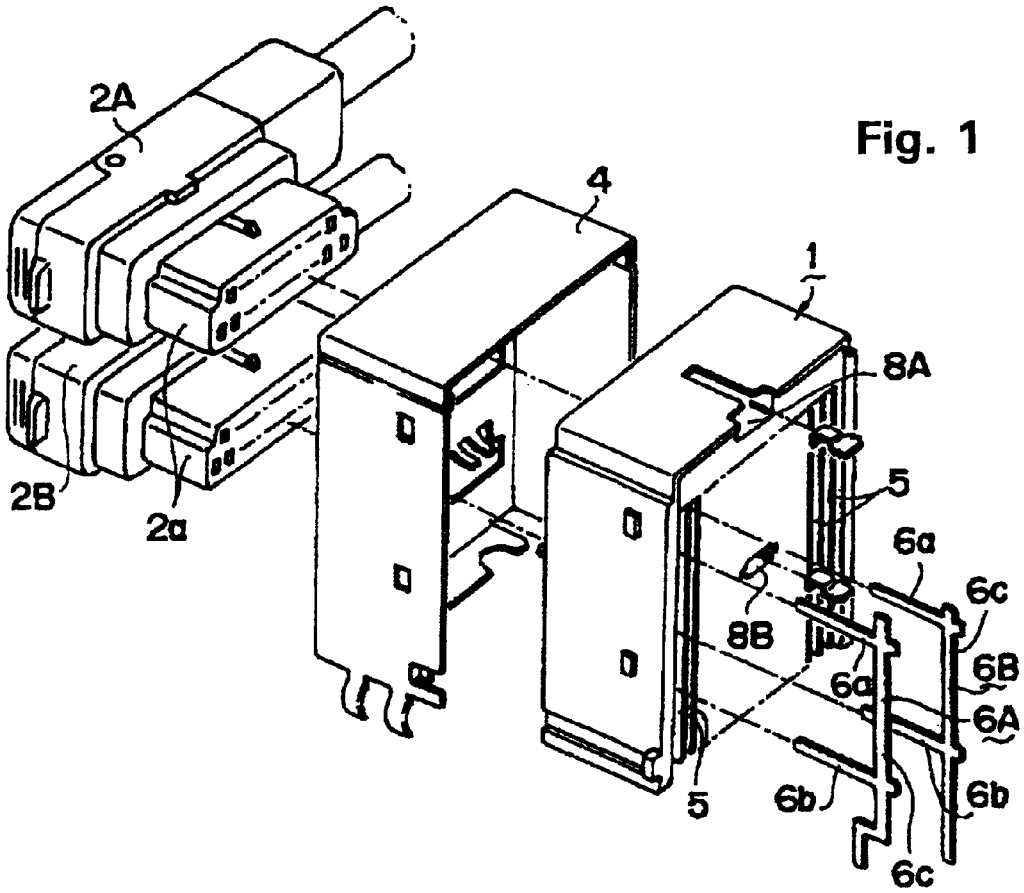
FIG. 1 is an exploded perspective drawing showing the relationship between the connector socket and the connector plug in the present invention.

Inside molded block 1 a pair of roughly horizontal latch attachment openings 8A, 8B are formed in the upper portions of plug insertion openings 3A, 3B. Lock claws 2*a* of connector plugs 2A, 2B snap into latch attachment openings 8A, 8B when plugs B1, B2 are fully inserted. One end of latch attachment openings 8A, 8B is open to the back surface of molded block 1, as best seen in FIGS. 1 and 4. Metallic latch members 9A, 9B (FIG. 2) are inserted through the open ends of latch openings 8A, 8B into latch attachment openings 8A, 8B where they are fixed in place. Metallic latch members 9A, 9B, engage lock claws 2*b* of connector plugs 2A, 2B, thereby providing wear resistance.

Figure 2:
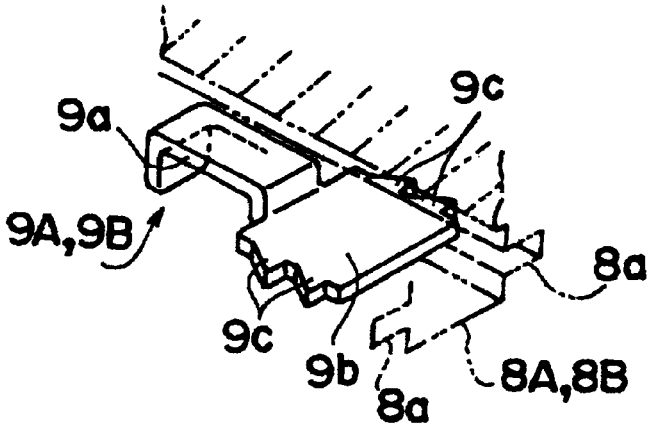
FIG. 2 is an expanded perspective drawing of the latch member used in the connector socket.
Figure 5:
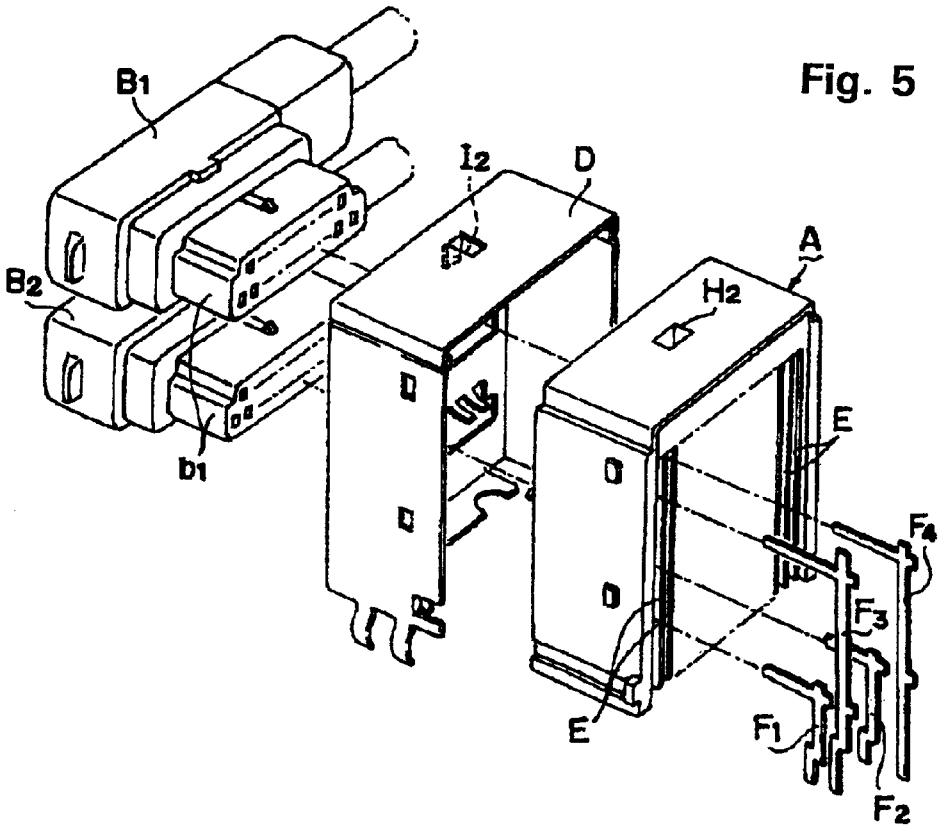
Fig. 5 PRIOR ART
FIG. 5 is an exploded perspective drawing showing the relationship between the connector socket and the connector plug in a conventional device.
Figure 6:
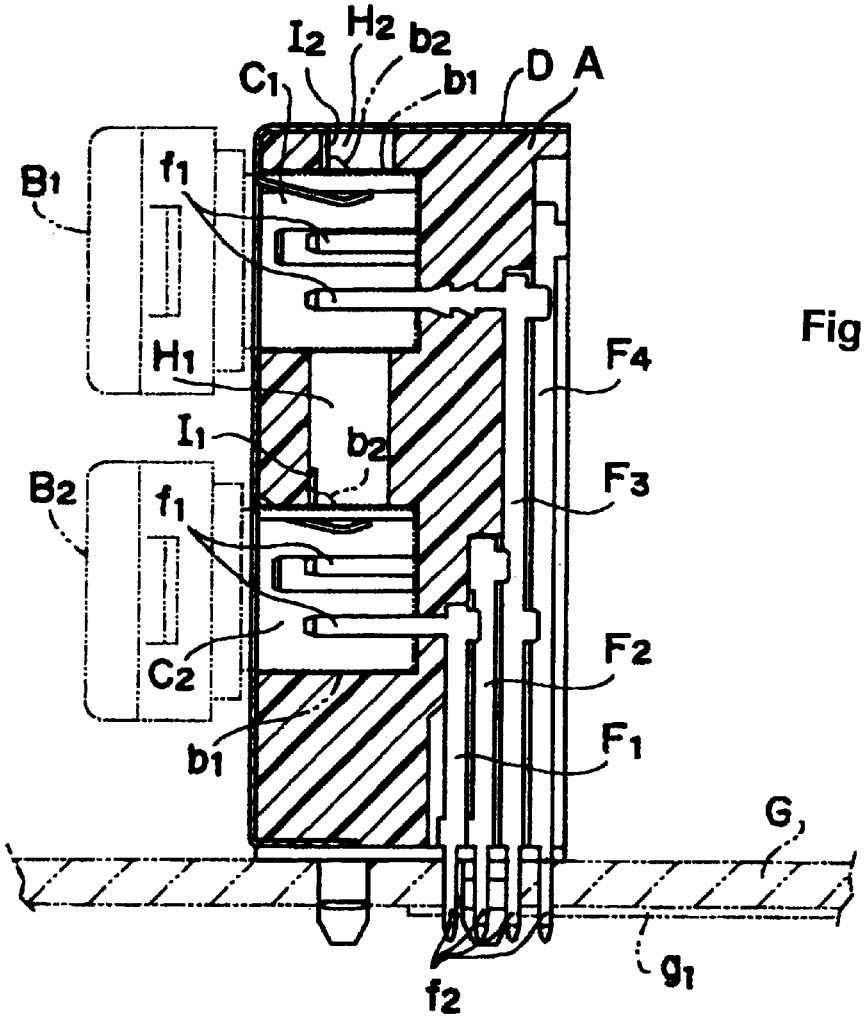
Fig. 6 PRIOR ART
FIG. 6 is an enlarged cross-section drawing of the in a conventional device.

Referring to FIG. 2, latch members 9A, 9B are formed by bending a metal plate and comprise: an engagement section 9*a* formed in a "C", or inverted "U" shape; a fixed support piece 9*b*, and integral with, engagement section 9*a*. Reverse engagement claws 9*c* are formed on both side surfaces of fixed support piece 9*b*.

Guide grooves 8*a* extend outward from latch attachment openings 8A, 8B. Guide grooves 8*a* have a groove width slightly smaller than the width of fixed support piece 9*b* of latch members 9A, 9B. Fixed support pieces 9*b* are inserted into guide grooves 8*a*, and forced into latch attachment openings 8A, 8B using a fitting device. Because guide grooves 8*a* are slightly narrower than fixed support pieces 9*b*, reverse engagement claws 9*c* become embedded in the resin at the lateral extremities of guide grooves 8*a*, thereby firmly retaining latch members 9A, 9B in position. This results in latch members 9A, 9B being fixed inside latch attachment openings 8A, 8B facing plug insertion openings 3A, 3B. The presence of reverse engagement claw 9*c* makes the retention of latch members 9A, 9B permanent and prevents latch members 9A, 9B from slipping out of latch attachment openings 8A, 8B.

Since the connector socket according to the embodiment shown in the drawings is structured as described above, molded block 1 and latch members 9A, 9B can be produced separately. Then, latch members 9A, 9B need only be pressed into latch attachment openings 8A, 8B of molded block 1. Thus, compared to the operation of insert molding a latch piece, the production costs are significantly reduced.

When the connector socket is assembled, lock claws 2*b* of connector plugs 2A, 2B projecting into latch attachment openings 8A, 8B, contact the metallic wear-resistant engagement section 9*a* of latch members 9A, 9B. This provides a connector socket with a long lifespan and significant market value.

Also, in the connector socket according to the embodiment shown in the drawings, latch attachment openings 8A, 8B are formed on molded block 1 so that they connect to plug insertion openings 3A, 3B with one end of latch attachment openings 8A, 8B open to the back surface of molded block 1. Thus, this structure can be used for connector sockets having any number of plug insertion openings 3A, 3B. For example, a connector socket having 3, 4 or more plug insertion openings is possible.

With the present invention a connector socket with very low production costs can have a plurality of plug insertion openings, with a metallic latch member that can reliably engage a lock claw of a connector plug.

In the invention, the latch member comprises a "C"-shaped engagement section and a fixed support piece integral with an end of engagement section. Reverse engagement claws on the side surfaces of the fixed support piece dig into the sides of an opening to retain the latch member in place permanently. Thus, the latch piece provides high positioning accuracy simply by pressing the latch member into the latch attachment opening.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A connector socket for connector plugs of a type having a lock claw which enters said connector socket during mating, comprising:

a plurality of plug insertion openings in a first surface of a molded block;

a plurality of latch attachment openings in said molded block;

said plurality of latch attachment openings extending from said plurality of plug insertion openings to a second surface of said molded block, said second surface being opposed to said first surface;

a plurality of metallic latch members;

said metallic latch members including an engagement section integral with a fixed support piece;

each of said latch attachment openings capable of receiving one of said metallic latch members inserted from a lateral direction crossing a plane of said second surface of said molded block;

said engagement sections being positioned inside said plug insertion openings;

each of said latch attachment openings including at least one laterally extending guide groove;

each of said fixed support pieces including at least one reverse engagement claw dimensioned and positioned to engage a cooperating surface in each of said at least one guide grooves, and thereby to retain said latch members in position substantially permanently; and said engagement sections being disposed in a position in said plug insertion openings providing engagement with said lock claws when said connector plugs are inserted in said plug insertion openings.

2. A connector socket according to claim 1 wherein:

said engagement section is generally "C"-shaped;

said fixed support piece is integral with one end of said engagement section; and said fixed support piece includes first and second reverse engagement claws to engage first and second opposed side surfaces of said guide groove.

3. A connector socket comprising:

a molded block;

a connector insertion plug opening for a connector plug in a first surface of said molded block;

a latch attachment opening in said molded block;

said latch attachment opening extending from said connector insertion plug opening through a second opposed surface of said molded block;

said latch attachment opening including first and second laterally extending guide grooves opening to said second surface;

a metallic latch member;

said metallic latch member including an engagement section and first and second laterally extending fixed support pieces;

said fixed support pieces including at least one reverse engagement claw extending outward therefrom; and said first and second laterally extending fixed support pieces including lateral edges fitting tightly against outer surfaces of said guide grooves, whereby said at least one reverse engagement claw protrudes into said molded block and retains said metallic latch member in place.

* * * * *